United States Patent [19]

Kuo

[11] Patent Number: 4,930,670

[45] Date of Patent: Jun. 5, 1990

[54] PUMPING MECHANISM FOR DISPENSING LOTION IN BOTTLE/CONTAINER

[75] Inventor: Frauk Kuo, Taichung Hsien, Taiwan

[73] Assignee: Smiley Chien, Taipei, Taiwan

[21] Appl. No.: 342,838

[22] Filed: Apr. 25, 1989

[30] Foreign Application Priority Data

Mar. 17, 1989 [TW] Taiwan ..... 78202384

[51] Int. Cl.[5] ..... B65D 88/54

[52] U.S. Cl. ..... 222/321; 222/341; 222/375; 222/385; 417/514

[58] Field of Search ..... 222/321, 341, 375, 385, 222/503; 417/514, 511

[56] References Cited

U.S. PATENT DOCUMENTS

| | | | |
|---|---|---|---|
| 3,187,960 | 6/1965 | Gorman | 222/321 |
| 3,229,863 | 1/1966 | Scoggin, Jr. et al. | 222/321 |
| 3,362,344 | 1/1968 | Duda | 417/514 |
| 3,414,169 | 12/1968 | Corsette | 222/321 |
| 3,724,726 | 4/1973 | Susuki et al. | 222/321 |
| 4,435,135 | 3/1984 | Knickerbocker | 417/511 |
| 4,607,765 | 8/1986 | Ruscitti | 222/321 |

*Primary Examiner*—Kevin P. Shaver
*Assistant Examiner*—Gregory L. Huson
*Attorney, Agent, or Firm*—Browdy & Neimark

[57] ABSTRACT

A pumping mechanism for a bottled lotion is constructed so that lotion is prevented from flowing out of the bottle if the bottle is inadvertently not placed upright. The pumping mechanism includes a hollow cylindrical member, a piston member, a hollow operating rod, a cap, a hollow pressing member, a ball, an upper valve, and a compression spring arranged in a manner so that when the operating rod is pressed downward, it will disengage the upper valve from the piston member before the bottom end thereof matches against the piston member.

1 Claim, 5 Drawing Sheets

PUMPING MECHANISM FOR DISPENSING LOTION IN BOTTLE/CONTAINER

BACKGROUND OF THE INVENTION

The present invention relates to a bottle for containing lotion therein, and more particularly to a pumping mechanism therefor.

It is well known to obtain lotion, e.g. a hair shampoo or a cleaning agent, from a bottle and/or container by hand-squeezing the bottle/container. It is also known to obtain the lotion out of a bottle/container by a pumping mechanism which can be used in an energy-saving manner.

As shown in FIGS. 1–3, a typical pumping mechanism 10 mainly includes a hollow cylindrical member 11 thereunder mounted a diptube 112 and having a reservoir room 111 defining at the lower portion thereof a valve seat 113, seating thereon a ball 114, and a piston 13 positioned in cylindrical member 11. Formed thereabove is an upper valve seat 131, seating thereon an upper ball 132, a compression spring 12 mounted between valve seat 113 and piston 13, an operating rod 14 mounted above piston 13 and having a through passage 141, a securing cover 15 for screwing onto a lotion bottle/container, a cap member 16, and a pressing member 17 liquid-communicable connected to operating rod 14 and a nozzle 171 so that when pressing member 17 and operating rod 14 are pushed downward by an external pressure, piston 13 is moved downward accordingly, and the air and/or lotion contained in reservoir room 111 will push upward the ball 132 to thus discharge air and/or lotion through the passage 141 and nozzle 171. When external pressure applied on member 17 and rod 14 is released, spring 12 pushes upward piston 13 to thus form a vacuum reservoir room 111 to in turn move the lotion through diptube 112 into reservoir room 111. If pressing member 17 is pushed downward again, the bottled lotion stored in liquid room 111 will flow through piston 13 and through passage 141 to be discharged out of nozzle 171.

Experience reveals that when the lotion packed in a bottle/container is inadvertently not placed upright, balls 132, 114 respectively run away from valve seats 131, 113 and thus the lotion will flow freely from nozzle 171 out of the bottle which is a waste and is troublesome. This situation may also happen in transporation and is conventionally overcome by a cover 18 blocking up nozzle 171 which, however, is inconvenient and will be vain if cover 18 is lost, which is very possible.

SUMMARY OF THE INVENTION

It is therefore an object of the present invention to provide a pumping mechanism ensuring that a lotion will not uncontrolledly flow out of the bottle therefor.

According to the present invention, a pumping mechanism includes a hollow cylindrical member having a reservoir room and a valve seat and mounted thereunder a diptube, a piston member sleeved in the cylindrical member, a hollow operating rod having a top end and a bottom end, a cap medium passing therethrough the operating rod to protrude the bottom end in the cylindrical member, a hollow pressing member liquid-communicable connected to the top, a ball capable of seating itself on the valve seat, an upper valve engaging with the operating rod and capable of matching with the piston member, and a compression spring so that when the pressing member and the operating rod are pressed downward the operating rod will disengage the upper valve from the piston member to connect the reservoir room with the operating rod before the bottom end matches against the piston member. When they are released, the compression spring will match the upper valve against the piston member to thus form a vacuum in the reservoir room to in turn allow the ball to leave the valve seat to connect the liquid room with the diptube.

The present invention may best be understood through the following description with reference to the accompanying drawings, in which:

DETAILED DESCRIPTION OF THE PREFERRED EMBODIMENT

Figure 1:
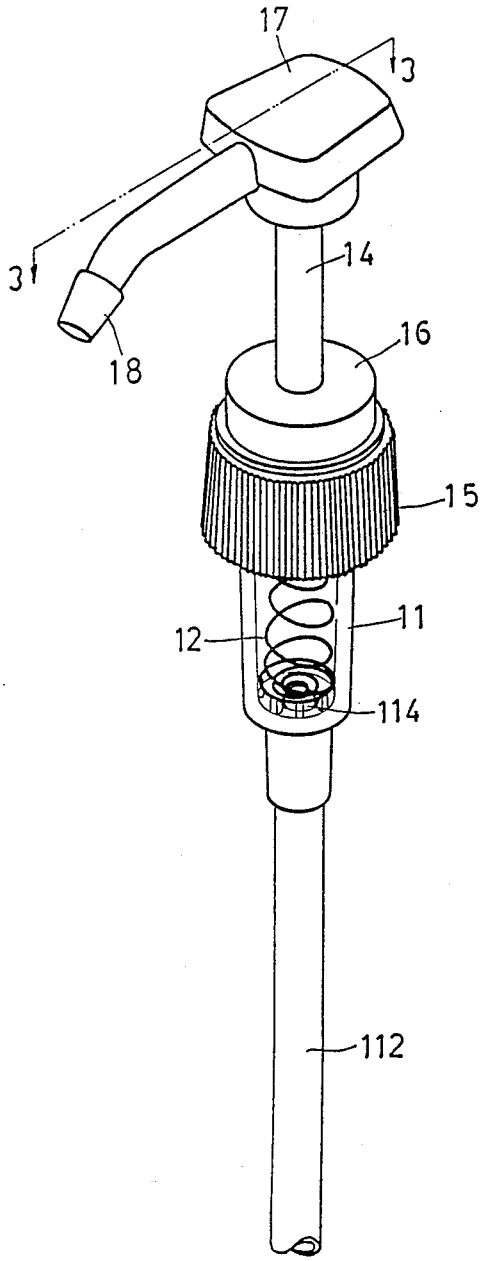
FIG. 1 PRIOR ART
FIG. 1 is a perspective view showing a pumping mechanism according to the prior art.
Figure 3:
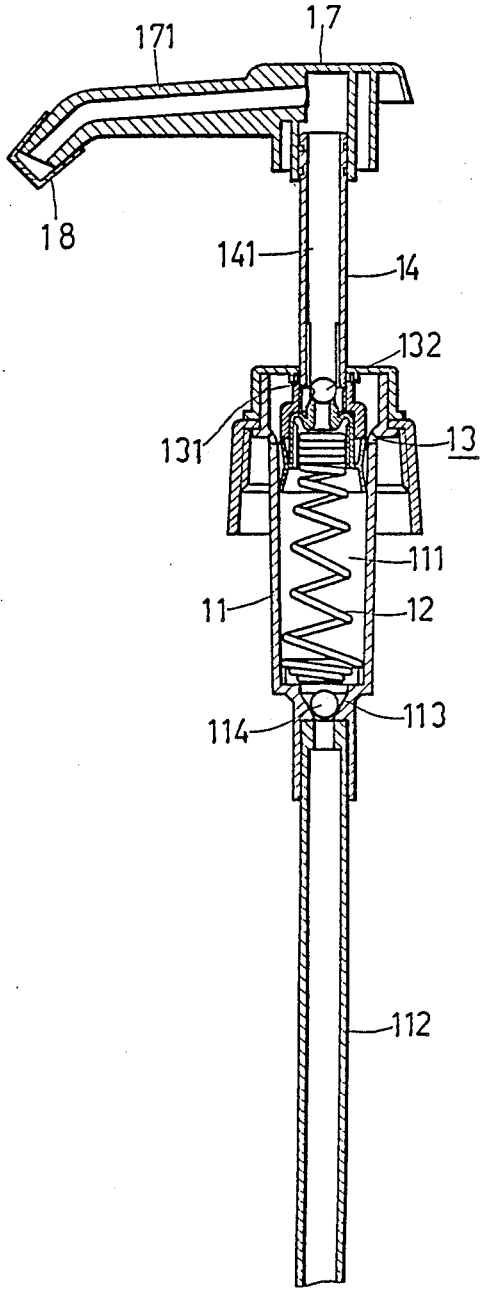
FIG. 3 PRIOR ART
FIG. 3 is a sectional view taken along line 3—3 in FIG. 1.
Figure 2:
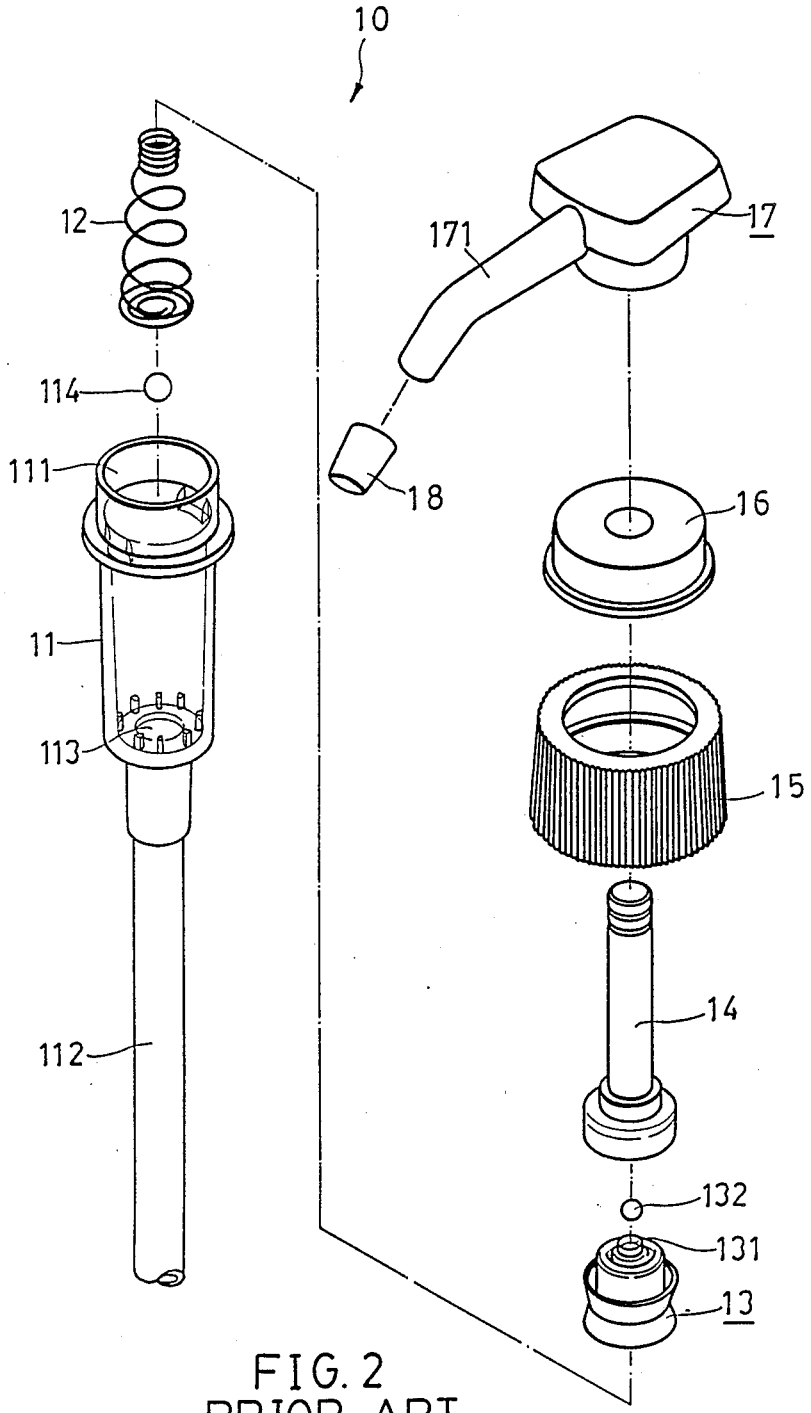
FIG. 2 PRIOR ART
FIG. 2 is an exploded view of a pumping mechanism in FIG. 1.
Figure 4:
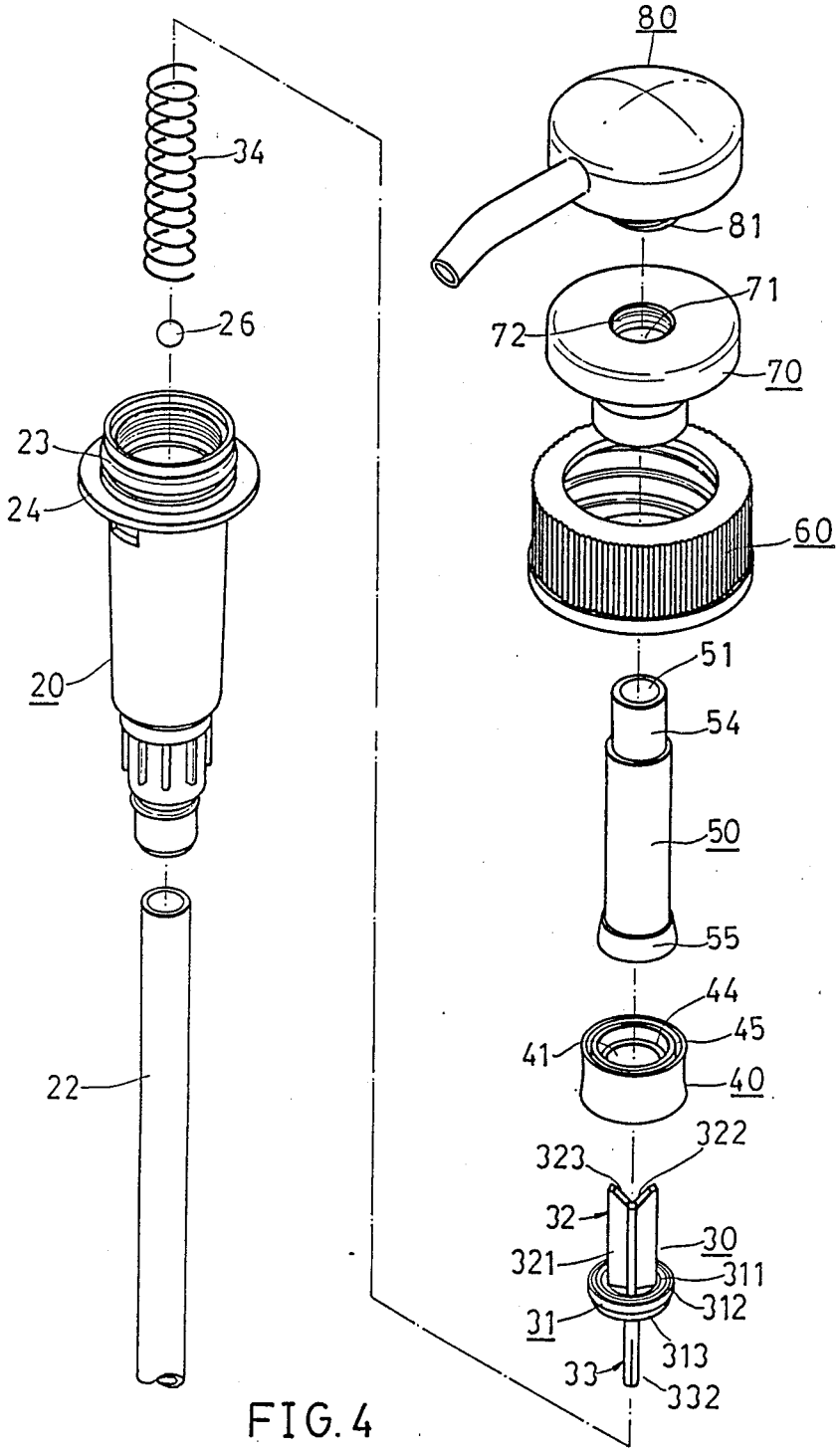
FIG. 4 is an exploded view showing a preferred embodiment of a pumping mechanism according to the present invention.
Figure 5:
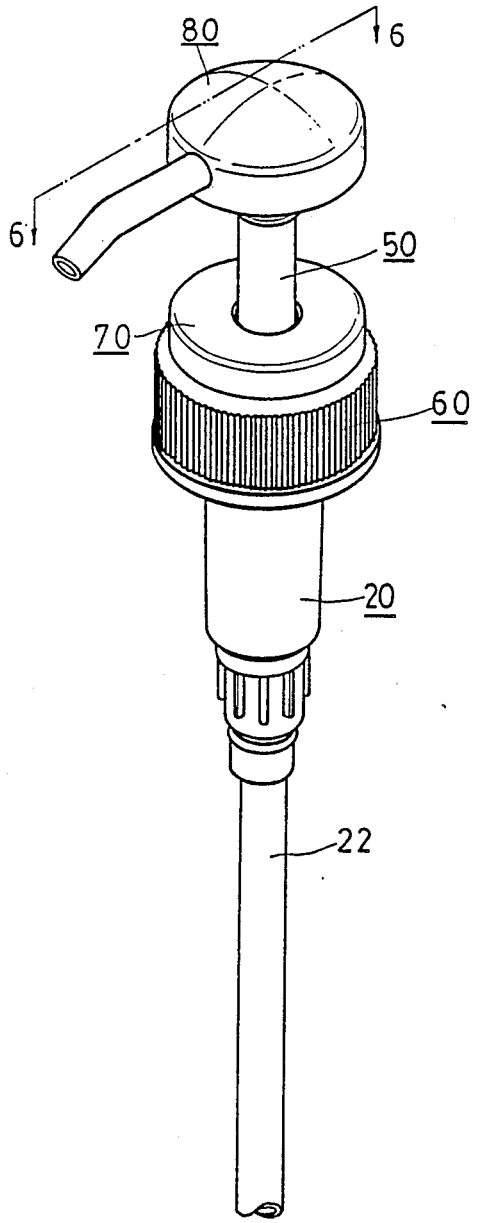
FIG. 5 is the perspective view showing a pumping mechanism in FIG. 4.
Figure 6:
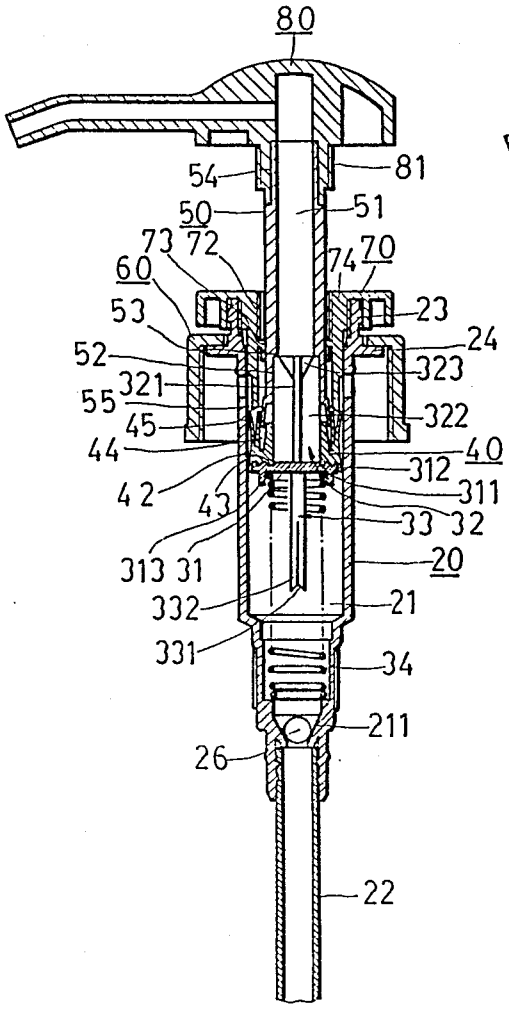
FIG. 6 is a sectional view taken along line 6—6 in FIG. 5.

Referring now to FIGS. 4–6, a pumping mechanism according to the present invention includes a hollow cylindrical member 20, an upper valve 30, a piston member 40, an operating rod 50, a cap medium having a securing cover 60 a cap member 70, and a pressing member 80. Cylindrical member 20 mounts thereunder a diptube 22 to be placed in a bottle/container containing therein a lotion and includes a reservoir room or chamber 21, a top engaging portion 23, an annular flange 24 positioning thereon securing cover 60 adapted to screw onto the bottle, and an inner wall defining at a lower portion thereof a valve seat 211 seating thereon a ball 26.

Upper valve 30 includes a body portion 31 having a bottom positioning ring 313 and two top concentric annular grooves 311, 312 of triangular crosssection, an upper engaging medium 32 having 3 upward rectangular wings 321 respectively having 3 top inner triangular indentations 323 to facilitate passing the lotion from 3 passages 322 of sectoral cross-section defined by wings 321 to operating rod 50, and a downward engaging rod 33 having a bottom end 331 split into 3 fingers 332. A compression spring 34 is positioned in cylindrical member 20 and mounted between positioning ring 313 and valve seat 211.

Piston 40 includes a through hole 41, two concentric bottom annular teeth 42, 43 respectively engageable with grooves 311, 312, a top inner annular indentation 44 and a top outer annular indentation 45 and is closely sleeved in cylindrical member 20 to be movable along the inner wall thereof.

Operating rod 50, being hollow, includes a top end 54, a bottom end having a bottom annular projection 55 engageable in inner indentation 44 when operating rod 50 is pressed downward, and a through hole which includes a shoulder surface 53 defining thereabove an upper hole 51 and thereunder a lower hole 52 receiving therein the upper portion of upper engaging medium 32 bearing against shoulder surface 53.

Cap member 70 includes a through hole 71, a female thread 72, an annular engaging piece 73 of inverted L-shaped cross-section tightly but movable receiving therein operating rod 50, and an engaging top 74 fixed to top engaging portion 23. Female thread 72 engages with a bottom male thread 81 of pressing member 80 liquid-communicable secured to top end 54.

Figure 7:
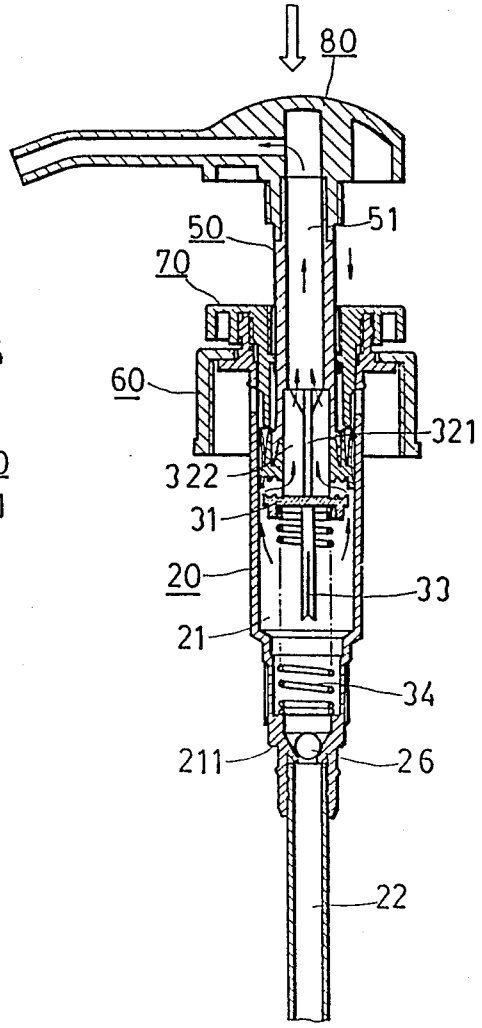
FIG. 7 is a sectional view showing the pumping mechanism in FIG. 4 in operation.

In operation, as shown in FIG. 7, when pressing member 80 and operating rod 50 are pressed downward, operating rod 50 will disengage upper valve 30 from piston member 40 to thus connect reservoir room 21 with lower hole 52 before bottom annular projection 55 matches with inner identation 44. If pressing member 80 and operating rod 50 are further pressed downward, piston 40 will be moved downward accordingly and thus the air/or lotion in reservoir room 21 will pass through passages 322, hole 51 and pressing member 80 to be discharged. After pressing member 80 and operating rod 50 reach their lowest positions and are released, compression spring 34 will again match annular teeth 42, 43 against annular grooves 311, 312 respectively and displace upward piston 40 to thus form a vacuum in reservoir room 21 to in turn allow ball 26 to leave valve seat 211 to suck from diptube 22 the bottled lotion into reservoir room 21. Now, if pressing member 80 and operating rod 50 are pressed downward again, the lotion in reservoir room 21 will be discharged from pressing member 80.

Figure 8:
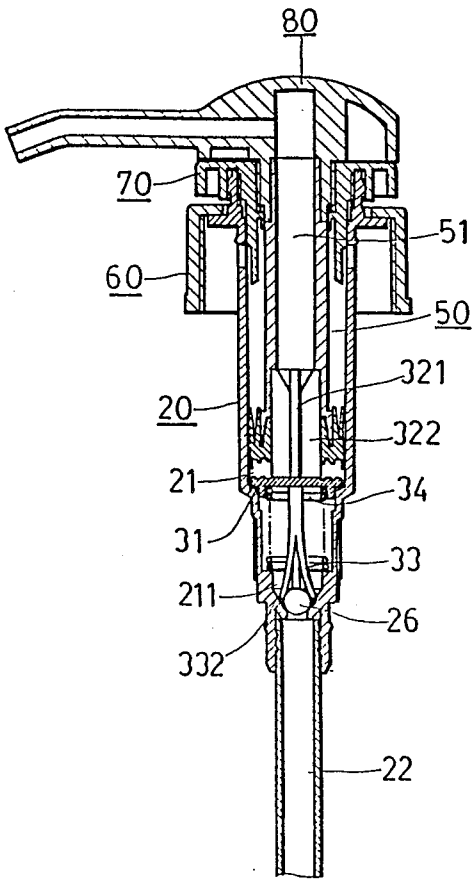
FIG. 8 is the sectional view showing a pumping mechanism in FIG. 4 being shortened in height in transportation.

In order to reduce the occupying volume of the present pumping mechanism in transportation, as shown in FIG. 8, pressing member 80 and operating rod 50 are pressed downward to engage together with threads 81, 72 to reduce the height of the present pumping mechanism, the fingers 332 of which stay on and hold against ball 26.

It goes without saying that the number of wings 321 or fingers 332 not be 3. In sum, the advantages achieved by the present pumping mechanism are as follows:

1. If the lotion packed bottle is inadvertently turned over, the bottled lotion can reach reservoir room 21 but cannot reach passages 322 since valve body 31 tightly matchs against piston 40. 2. It can be reduced in height in transportation to thus reduce the cost.

I claim:

1. A pumping mechanism comprising:

a hollow cylindrical member having a top portion, a lotion reservoir room, and an inner wall defining at a lower portion thereof a valve seat, and mounting thereunder a diptube adapted to be placed in a bottle containing therein a lotion for suction up therefrom said lotion into said lotion reservoir room;

a piston member sleeved in said cylindrical member and movable along said inner wall, said piston including a top annular indentation and at least a bottom annular tooth;

a hollow operating rod having a top end and a bottom end, said bottom end having an inner shoulder surface;

a cap medium including a securing cover and a cap member, said securing cover screwable onto said bottle, said cap member connected to said top portion and having an inner female thread, said cap medium allowing said operating rod to pass therethrough and to protrude from said bottom end in said cylindrical member;

a hollow pressing member lotion-communicable connected to said top end of said hollow-operating rod, and having a bottom male thread engageable with said female thread;

a ball capable of being seated on said valve seat to prevent said reservoir room from communicating with said diptube;

an upper valve positioned in said cylindrical member, having an upper engaging medium engaging with said operating rod, said upper engaging medium including at least two upward wings urging against said shoulder surface, and capable of matching said said piston member to prevent said operating rod from communicating with said reservoir room, and said upper valve including at least a top annular groove engageable with said bottom tooth and including a downward engaging rod having a bottom end split into at least three fingers.

a compression spring method mounted between said upper valve and said valve seat, in a manner that when said pressing member and said operating rod are pressed downward, said operating rod will disengage said upper valve from said piston member to communicate said reservoir room with said operating rod before said bottom end matches against said piston member, and when said pressing member and said operating rod are released, said compression spring will match said upper valve against said piston member again to thus form a vacuum in said reservoir room to in turn allow said ball to leave said valve seat to communicate said reservoir room with said diptube.

* * * * *